US007015788B2

(12) United States Patent
Iura

(10) Patent No.: US 7,015,788 B2
(45) Date of Patent: Mar. 21, 2006

(54) VARIABLE ELECTRONIC COMPONENT

(75) Inventor: Akiko Iura, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 11/079,544

(22) Filed: Mar. 9, 2005

(65) Prior Publication Data

US 2005/0200450 A1 Sep. 15, 2005

(30) Foreign Application Priority Data

Mar. 10, 2004 (JP) ..... 2004-067045

(51) Int. Cl.
*H01C 10/30* (2006.01)
*H01C 10/48* (2006.01)

(52) U.S. Cl. ..... 338/162; 338/163; 338/190

(58) Field of Classification Search ..... 338/162, 338/163, 164, 165, 166, 167, 202, 190–193
See application file for complete search history.

(56) References Cited

U.S. PATENT DOCUMENTS 5,053,741 A * 10/1991 Ueda ..... 338/162
5,134,383 A * 7/1992 Ueda ..... 338/162
5,293,525 A * 3/1994 Yoshimura ..... 338/162
5,315,283 A * 5/1994 Yoshimura ..... 338/162
6,317,022 B1 * 11/2001 Doi ..... 338/162
2004/0186349 A1 * 9/2004 Ikeda ..... 338/162

FOREIGN PATENT DOCUMENTS

JP 11-233316 8/1999

* cited by examiner

*Primary Examiner*—Tu Hoang
(74) *Attorney, Agent, or Firm*—Hamre, Schumann, Mueller & Larson, P.C.

(57) ABSTRACT

A variable electronic component includes an insulating substrate and a metal rotor rotatably attached to the upper surface of the substrate. The rotor includes a cup-shaped member attached to the substrate and having an upper end formed with an outward flange. The rotor also includes a plate member formed integral with the flange via a hinge portion. The plate member is arranged on an upper side or a lower side of the flange. The cup-shaped member or the plate member is formed with a recess, and the other is formed with a protrusion fitted into the recess.

6 Claims, 5 Drawing Sheets

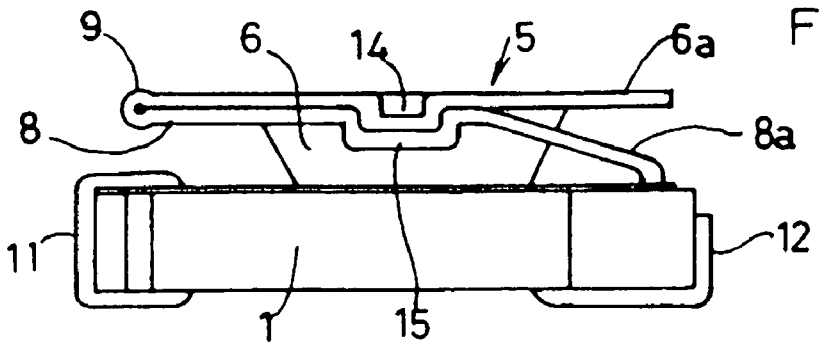
Fig.13
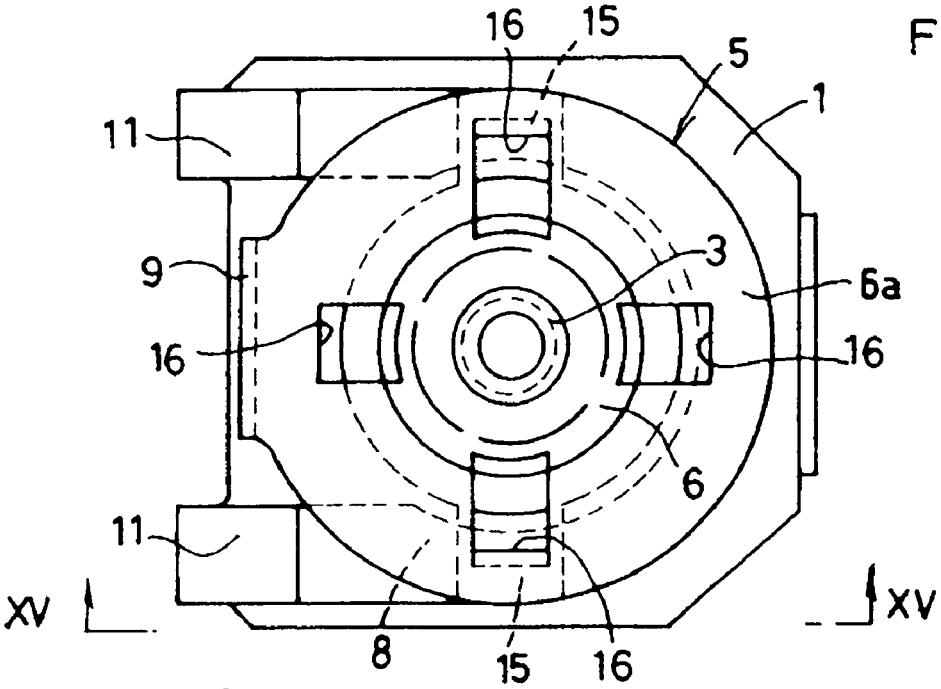
Fig.14
Fig.15
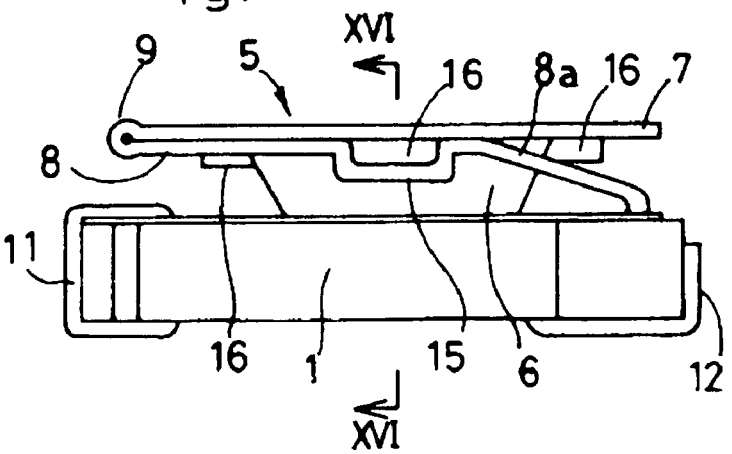
Fig.16
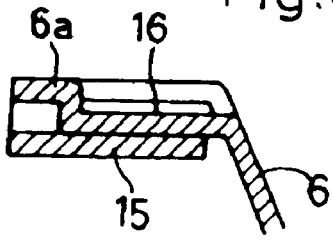

VARIABLE ELECTRONIC COMPONENT

BACKGROUND OF THE INVENTION

1. Field of the Invention

The present invention relates to a variable electronic component, and in particular to a chip-type variable resistor.

2. Description of the Related Art

Typically, a chip-type variable resistor (semifixed variable resistor) includes a ceramic insulating substrate (formed with a center hole vertically extending through the substrate), a metallic terminal plate (having a central axis and fitted into the center hole from below), and a metallic rotor provided on the upper surface of the substrate in a rotatable manner about the axis.

The rotor is a twofold type or a threefold type. The twofold-type rotor, for example, includes an upwardly open cup-shaped member (having an upper end formed with an outward flange), and an upper plate member (arranged on the upper side of the flange) or lower plate member (arranged on the lower side of the flange). The flange of the cup-shaped member and the upper or lower plate member are integrally connected to each other via a hinge which is provided at an appropriate position on the periphery of the flange.

In either type, the rotor can be produced in the following manner. First, an intermediate product is prepared by sheet metal processing with respect to a material metal sheet. This intermediate product, in an opened-up state, includes a cup-shaped member and an upper or lower plate member, which are formed integral with each other via a hinge portion. Then, the intermediate product is folded at the hinge portion, thereby causing the cup-shaped member and the upper or lower plate member to be vertically overlapped vertically. Thus, the required rotor is obtained. When use is made of an upper plate member, an engagement hole for engagement of a screw driver is made in the upper plate. When use is made of a lower plate member, a hole or a groove for engagement of a screw driver is made in the cup-shaped member.

The upper surface of the insulating substrate is formed with an U-shaped resistive layer, and the ends of the resistive layer are connected to side electrodes formed on a side surface of the substrate. The above-mentioned terminal plate is proved with an upward electrode located opposite to the side electrodes with respect to the rotor (in other words, the upward electrode and the side electrodes are symmetrical in position with respect to the rotor). The upward electrode and the two side electrodes are soldered to a printed circuit board, for example.

The rotor need be provided with a contact member to come into sliding contact with the resistive layer. When the upper plate member is used, the contact member is provided at the cup-shaped member. When the lower plate member is used, the contact member is provided at the lower plate member. In either case, the contact member is located opposite to the hinge portion with respect to the axis of the rotor, and held in resilient contact with the resistive layer.

The above-described twofold-type rotor is more advantageous than the threefold-type rotor in that the former can be smaller in height than the latter, and that the material cost and the production cost can be saved.

However, according to the prior art, the cup-shaped member is connected to the upper or lower plate member via only the hinge portion, which is rather narrow. In addition, the contact member is urged strongly to the resistive layer. Thus, as the rotor is rotated for resistance adjustment, the friction drag between the contact member and the resistive layer can become stronger than the bending strength of the hinge portion, whereby the upper or lower plate member may be deformed or broken. Another problem with the prior art is a failure of proper resistance adjustment, which can happen when the contact member is not rotated properly, that is, in conformity to the rotation of a screw driver used for resistance adjustment.

In this connection, JP-A-H11-233316 teaches a structure for preventing deformation and breakage of the lower plate member. Specifically, a tongue-like bent piece is provided at either the flange of a cup-shaped member or the lower plate member, while a cutout is provided at the other of the two members. The bent piece comes into engagement with the cutout for prevention of the lower plate member's deformation or breakage.

As noted above, the rotor is produced by folding an intermediate product at its hinge portion, so that the cup-shaped member and the upper or lower plate member are vertically overlapped. However, according to the teachings of JP-A-H11-233316, in forming the tongue-like bent piece, a material metal sheet is first subjected to a punching process to prepare an unbent tongue, and then to press working to bend the tongue. Unfavorably, such a multi-stage procedure results in an increased production cost. Further, the formation of the engagement cutout may reduce the mechanical strength of the member formed with the cutout.

SUMMARY OF THE INVENTION

The present invention has been proposed under the circumstances described above. It is therefore an object of the present invention to provide a variable electronic component with which the above-described problems are eliminated or at least alleviated.

According to the present invention, there is provided a variable electronic component that comprises an insulating substrate and a metal rotor rotatably attached to an upper surface of the substrate. The rotor includes a cup-shaped member attached to the substrate and having an upper end formed with an outward flange, while also including a plate member formed integral with the flange via a hinge portion. The cup-shaped member is open upward, and the plate member is arranged on an upper side or a lower side of the flange. One of the cup-shaped member and the plate member is formed with a recess, while the other of the cup-shaped member and the plate member is formed with a protrusion fitted into the recess. As readily understood, the recess may be formed at the cup-shaped member, and the protrusion at the plate member, or the recess may be formed at the plate member, and the protrusion at the cup-shaped member. It is also possible that each of the cup-shaped member and the plate member is formed with both a recess and a protrusion. In the present invention, the protrusion may be defined as a deformation in a metal sheet caused by a pressure applied in the thickness direction of the sheet. In light of this, the protrusion of the present invention excludes the conventional tongue-like bent piece, which is prepared by punching (to make an unbent tongue) and bending the tongue.

Preferably, the cup-shaped member and the plate member are formed integral with each other by sheet metal processing. As a result of the sheet metal processing, an opened-up assembly of the cup-shaped member and the plate member is obtained. Then, to produce the desired rotor, the opened-up assembly is folded at the hinge portion, so that the flange of the cup-shaped member and the plate member are overlapped, with the protrusion fitted into the recess.

Preferably, the plate member may be arranged either on the upper side of the flange or on the lower side of the flange.

Preferably, at least one of the cup-shaped member and the plate member is formed with an engagement part with which a screw driver engages.

Preferably, at least one of the cup-shaped member and the plate member is provided with a contact member held in contact with an adjustment layer formed on the upper surface of the substrate.

Preferably, the plate member comprises a circular plate arranged on the upper side of the flange. The circular plate is formed with an engagement hole with which a screw driver engages for resistance adjustment. The cup-shaped member is provided, at a portion opposite to the hinge portion with respect to a rotating axis, with a contact member extending downward.

Preferably, the upper surface of the substrate is formed with a resistive layer, and the rotor is provided with a contact member held in sliding contact with the resistive layer upon rotation of the rotor.

According to the present invention, the cup-shaped member and the plate member of the rotor can be held in non-slipping engagement with each other by the fitting of the protrusion into the recess as well as by the fixation of the hinge portion. Thus, as the rotor is rotated, the hinge portion (and its nearby portions) undergoes less stress, which is advantageous to the prevention of deformation or breakage of the plate member. In addition, the movable contact member is properly operated in conformity to the rotation of a screw driver, whereby a fine adjustment of resistance value can be performed.

Both the recess and the protrusion can be simultaneously formed by e.g. a press machine as the cup-shaped member is being formed. Thus, there is no need to perform a bending process disclosed in JP-A-H11-233316, which is advantageous to the reduction of production costs. Further, the formation of the recess and the protrusion can improve the mechanical strength of the cup-shaped member and the plate member.

Other features and advantages of the present invention will become apparent from the detailed description given below with reference to the accompanying drawings.

BRIEF DESCRIPTION OF THE DRAWINGS

FIG. 13 is a front view taken along lines XIII—XIII in FIG. 12;

FIG. 14 is a plan view showing a variable resistor according to a fifth embodiment of the present invention;

FIG. 15 is a front view taken along lines XV—XV in FIG. 14; and

FIG. 16 is a sectional view taken along lines XVI—XVI in FIG. 15, with some portions omitted.

DETAILED DESCRIPTION OF THE PREFERRED EMBODIMENTS

Figure 1:
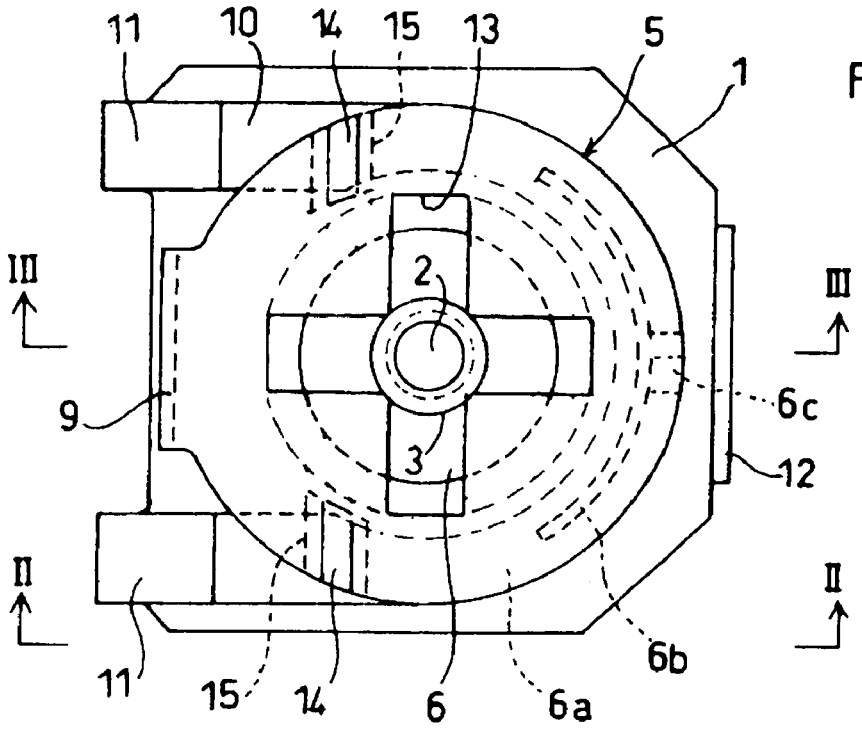
FIG. 1 is a plan view showing a variable resistor according to a first embodiment of the present invention.

Preferred embodiments of the present invention will be described below with reference to the accompanying drawings. Hereinafter, the present invention is explained based on several examples of chip-type variable resistors. However, it should be appreciated that the present invention is not limited to these, but is applicable to many devices other than the illustrated chip-type variable resistors.

(1) First Embodiment (FIGS. 1–6)

FIGS. 1–6 illustrate a variable resistor according to a first embodiment of the present invention.

The resistor of the first embodiment includes an insulating substrate 1 made of e.g. ceramic and formed with a central hole 2 extending vertically through the substrate 1. The substrate 1 is generally rectangular as viewed in plan. The illustrated resistor further includes a metallic terminal plate 4 (provided with an upright central shaft 3) and a metallic rotor 5 arranged on the upper surface of the substrate 1. The central shaft 3 is fitted into the hole 2 from below, and the rotor 5 is rotatably connected to the shaft 3.

The rotor 5 includes an upwardly open cup-shaped member 6 and a circular upper plate 7. The cup-shaped member 6 has an upper end formed with a flange 6*a* extending outward (i.e., horizontally, in FIGS. 2 and 3). The upper plate 7, placed upon the cup-shaped member 6, is formed integral with the flange 6*a* via a hinge portion 9. The upper plate 7 is formed with a driver engagement hole 13 into which the tip of a screw driver can be inserted for performing resistance adjustment. In the illustrated example, the hole 13 is crisscrossed, though the present invention is not limited to this. The hole 13 may be a straight slot or in other forms. The cup-shaped member 6 has a circular bottom plate which is rotatably fixed to the upper surface of the substrate 1 by the caulking on the upper end of the central shaft 3 (see FIG. 3).

The upper surface of the substrate 1 is formed with a U-shaped resistive layer 10 that partially surrounds the central shaft 3. Each end of the resistive layer 10 is connected to a side electrode 11 which is exposed at least on the side surface and bottom surface of the substrate 1. The terminal plate 4 is provided with an upright center electrode 12 extending on a side surface of the substrate 1. The center electrode 12 is arranged opposite to the side electrodes 11 with respect to the central hole 2.

The flange 6*a* of the cup-shaped member 6 is formed with an arcuate slit 6*b* located opposite to the hinge portion 9 with respect to the hole 2. Adjacent to the slit 6*b* (and on the radially outer side thereof) is provided a contact member 6*c* extending downward from the flange 6*a*. The contact member 6*c*, located opposite to the hinge portion 9 with respect to the hole 2, has a lower end held in contact with the resistive layer 10. The contact member 6*c* may be produced by causing the relevant portion of the flange 6*a* to bulge downward.

Figure 2:
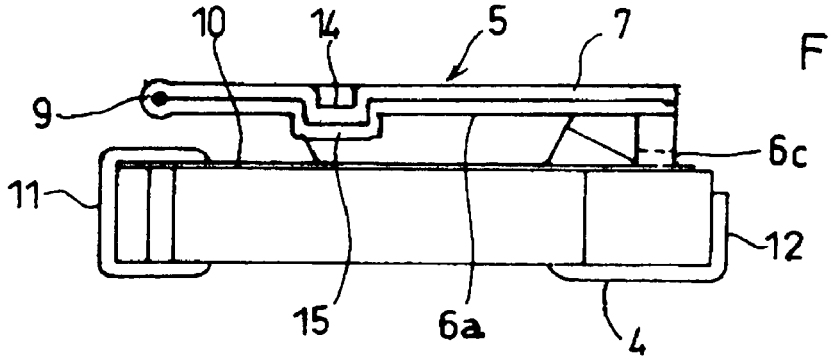
FIG. 2 is a front view taken along lines II—II in FIG. 1.
Figure 3:
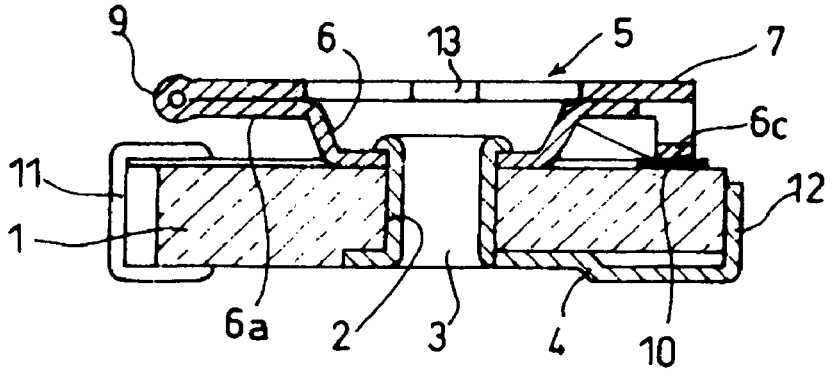
FIG. 3 is a sectional view taken along lines III—III in FIG. 1.

As shown in FIGS. 1 and 2, for example, the upper plate 7 has two downwardly bulging portions (or downward protrusions) 14 located closer to the hinge portion 9 than to the contact member 6*c*. Correspondingly, the flange 6*a* of the cup-shaped member 6 has two recesses (or upwardly open recesses) 15 into which the downward protrusions 14 are fitted, respectively. Preferably, the recesses 15 and the protrusions 14 are sufficiently spaced away from the hinge portion 9 without interfering with the driver engagement hole 13.

According to the present invention, it is possible that the flange 6*a* is formed with upwardly bulging portions (or upward protrusions), and that the upper plate 7 is formed with recesses (or downwardly open recesses) into which the upward protrusions are fitted. Preferably, however, the upper plate 7 is formed with downward protrusions, as shown in FIG. 2, so that a vacuum suction collet properly handles the variable resistor during an automatic transfer process, for example. The downward protrusions are also preferable for avoiding interference with the resistance adjustment screw driver.

In the illustrated embodiment, each recess 15 forms a straight groove as viewed from above in FIG. 2, for example, while each protrusion 14 forms a straight ridge as viewed from below. These grooves and ridges, as shown in FIG. 1, extend in parallel to the hinge portion 9. According to the present invention, the grooves and ridges may extend radially as viewed from the center of the rotor, or they may extend perpendicularly to the hinge portion 9, as viewed in FIG. 1.

Figure 4:
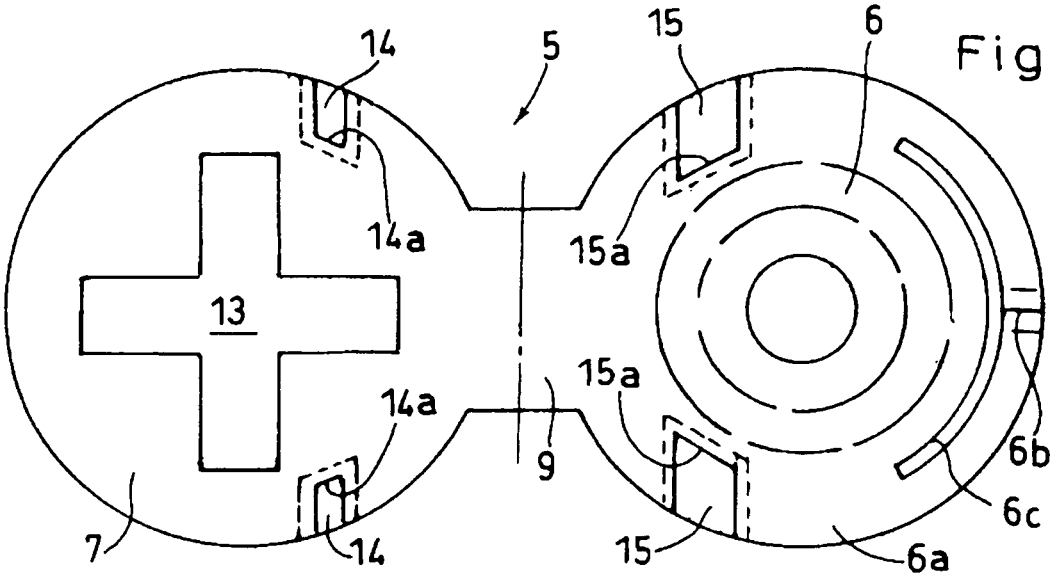
FIG. 4 is an opened-up plan view showing a rotor used for the resistor of the first embodiment.
Figure 5:
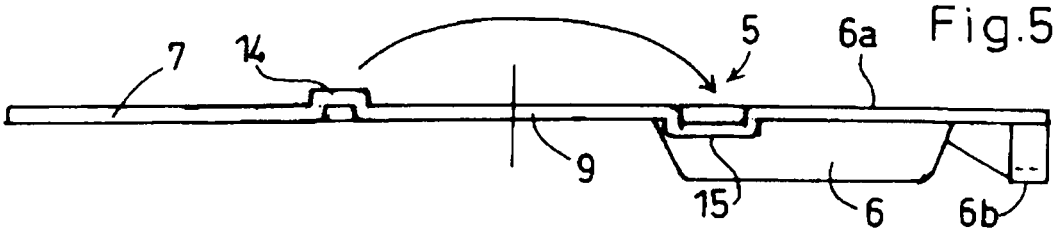
FIG. 5 is a front view showing the rotor of FIG. 4.
Figure 6:
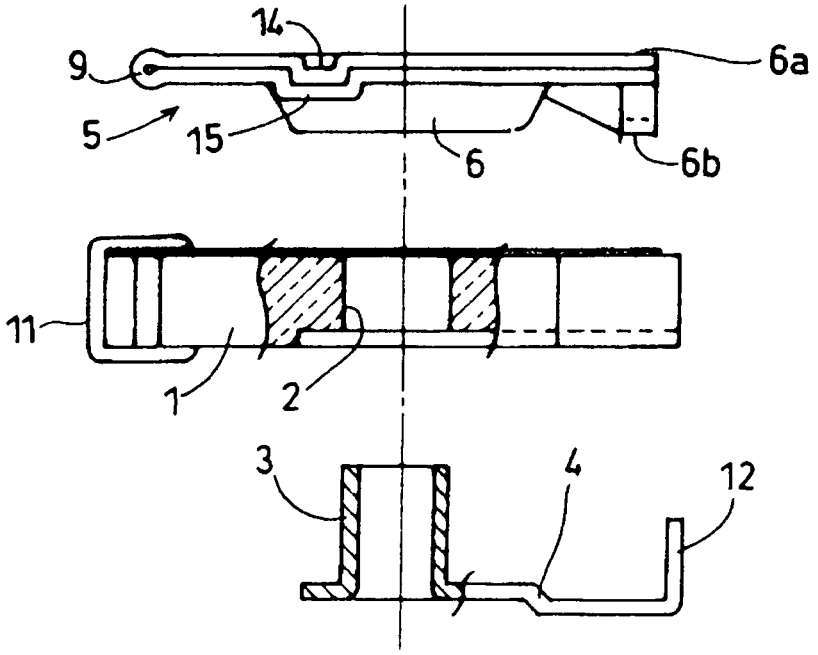
FIG. 6 is an exploded front view showing the rotor, the substrate and the terminal electrode, with some parts removed.

FIG. 4 is a plan view showing the rotor 5 in its opened-up state. For producing the rotor 5, an intermediate product (or semifinished product) shown in FIGS. 4 and 5 is first prepared by press working performed on a metal sheet material. By press working, the formation of the recesses 15 and the protrusions 14 can be performed simultaneously with the bulging or drawing formation of the cup-shaped member 6.

The intermediate product is then folded at the hinge portion 9 so that each of the protrusions 14 is fitted into the relevant one of the recesses 15. Thus, the desired rotor 5 is obtained. Since the cup-shaped member 6 and the upper plate 7 are fixed to each other by the coupling of the protrusions 14 and the recesses 15, the hinge portion 9 undergoes less stress in performing resistance adjustment. As a result, it is possible to prevent the upper plate 7 and the hinge portion 9 from being deformed at the time of the resistance adjustment.

Referring to FIG. 4, in the illustrated example, each protrusion 14 has an end wall 14*a*, and each recess 15 has an end wall 15*a*. According to the present invention, however, these end walls may not be provided. In this case, each protrusion 14 forms a ridge which is open at its both ends (the ends spaced from each other in the longitudinal direction of the ridge). Likewise, each recess 15 forms a groove which is open at its both ends (the ends spaced from each other in the longitudinal direction of the groove). Such an arrangement is advantageous for reducing stress exerted on a tool (e.g. a punch) used for producing the protrusions and the recesses. According to the present invention, each protrusion 14 may gradually become higher as proceeding outward from the end 14*a*, and each recess 15 may gradually become deeper as proceeding outward from the end 15*a*.

Figure 7:
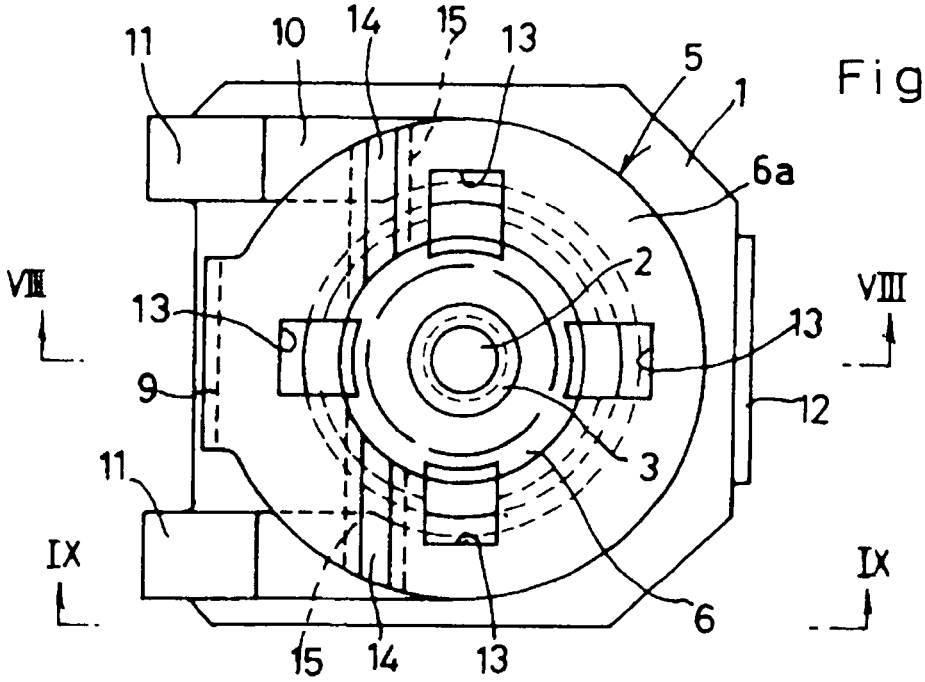
FIG. 7 is a plan view showing a variable resistor according to a second embodiment of the present invention.
Figure 8:
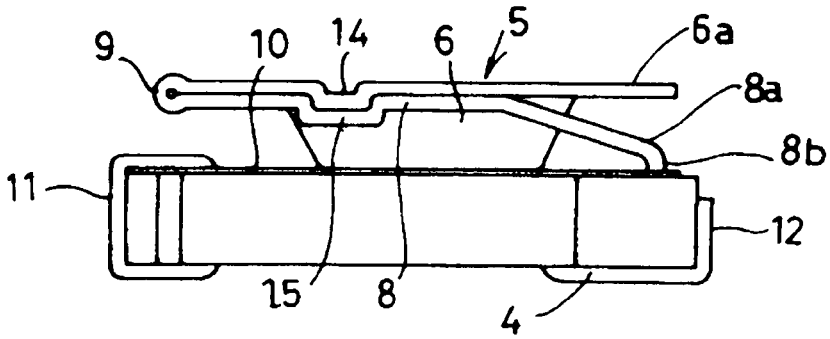
FIG. 8 is a sectional view taken along lines VIII—VIII in FIG. 7.
Figure 9:
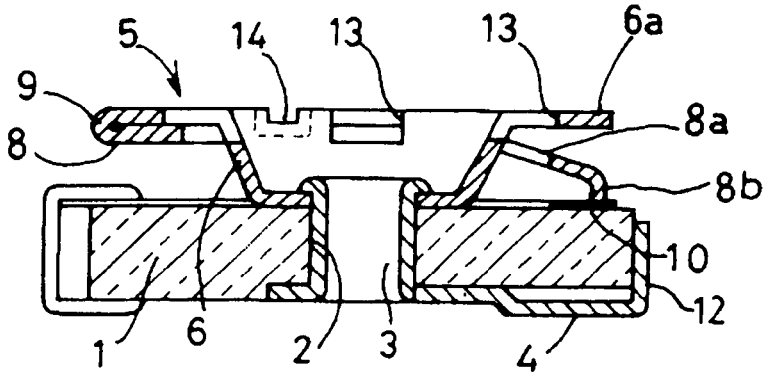
FIG. 9 is a sectional view taken along lines IX—IX in FIG. 7.

(2) Second Embodiment (FIGS. 7–9)

FIGS. 7–9 illustrate a variable resistor according to a second embodiment of the present invention.

In this embodiment, the rotor 5 includes a ring-shaped lower plate 8 in place of the upper plate 7 of the first embodiment. The lower plate 8 is disposed on the lower side of the flange 6*a* of the cup-shaped member 6. The lower plate 8 is held in partial contact with the flange 6*a*. Specifically, as shown in FIG. 8, generally the left half or more of the lower plate 8 (an area of the plate 8 that is adjacent to the hinge portion 9) is held in contact with the lower side of the flange 6*a*, while the remaining part of the plate 8 provides a slant portion 8*a* extending toward the resistive layer 10. The slant portion 8*a* includes a lower contact end 8*b* brought into sliding contact with the resistive layer 10.

As shown in FIG. 7, the cup-shaped member 6 is formed with a set of engagement holes 13 into which the tip of a screw driver is inserted for resistance adjustment. The engagement holes 13 may be formed by punching, for example. In the illustrated example, the four holes 13 are arranged for the use of a crisscross-head screw driver, though the present invention is not limited to this. The arrangement of the holes 13 may correspond to the use of a flat blade screw driver.

In the second embodiment again, the protrusion-recess coupling means is employed for fixing the flange 6*a* and the lower plate 8 to each other. Specifically, in the illustrated example, the flange 6*a* is formed with two downward protrusions 14, while the lower plate 8 is formed with two recesses 15 into which the downward protrusions 14 are fitted, respectively. As seen from the figures, each protrusion 14 extends through the flange 6*a* (see FIG. 7 in particular), with its both ends opened. Correspondingly, each recess 15 extends through the lower plate 8, with its both ends opened. With such an arrangement, the same advantages as those described above with respect to the first embodiment can be enjoyed.

Figure 10:
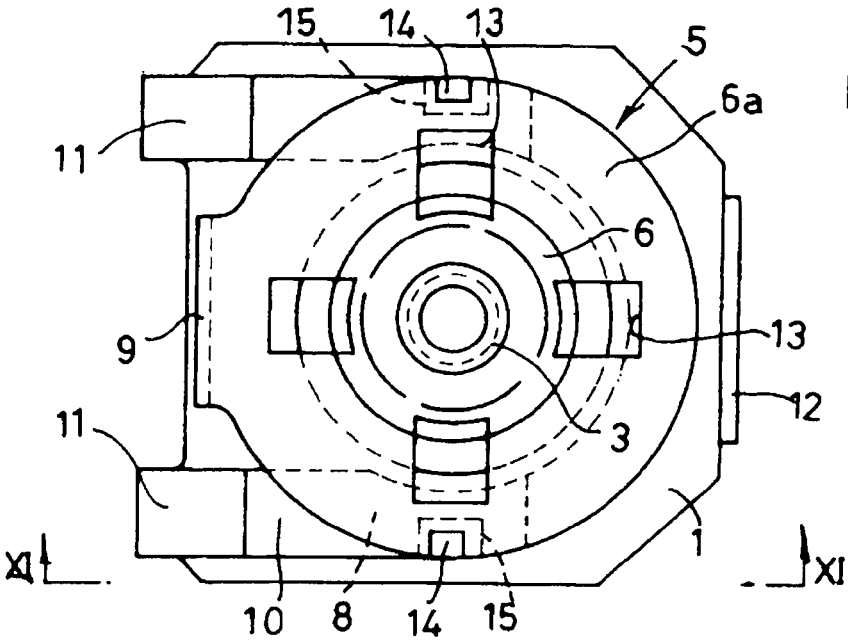
FIG. 10 is a plan view showing a variable resistor according to a third embodiment of the present invention.
Figure 11:
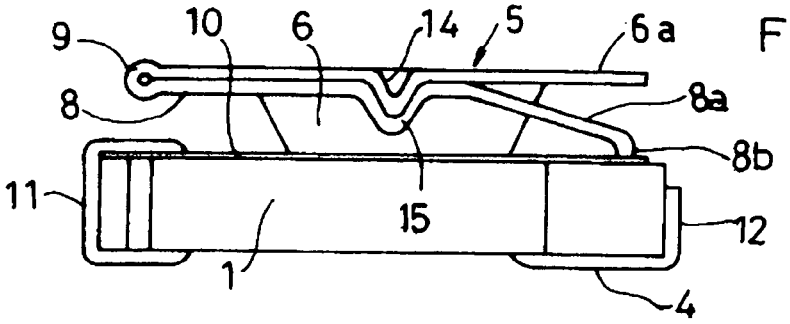
FIG. 11 is a front view taken along lines VXI—VXI in FIG. 10.

(3) Third Embodiment (FIGS. 10–11)

FIGS. 10 and 11 illustrate a variable resistor according to a third embodiment of the present invention. The resistor of the third embodiment is generally the same as the resistor of the second embodiment described above, except for the configurations of the protrusions 14 and the recesses 15. Specifically, the protrusions 14 and the recesses 15 of the third embodiment have a triangular cross section (see FIG. 11), and they extend only partially in the flange 6*a* or the lower plate 8 (see FIG. 10). In the illustrated example, two coupling pairs (each pair consists of a protrusion and a recess) are provided, though the present invention is not limited to this. Three or more coupling pairs may be used for fixing the plate 8 to the flange 6*a*. In this case, the prescribed number of coupling pairs may be distributed at regular or irregular intervals around the rotating axis of the rotor 5.

According to the present invention, each of the protrusions 14 may be a dowel, a frustum or any other island-shaped member. In this case, the recess 15 may be replaced by a hole into which the island-shaped member is fitted.

As readily understood, the above-described features of the third embodiment are applicable to the case where the upper plate 7 is used.

Figure 12:
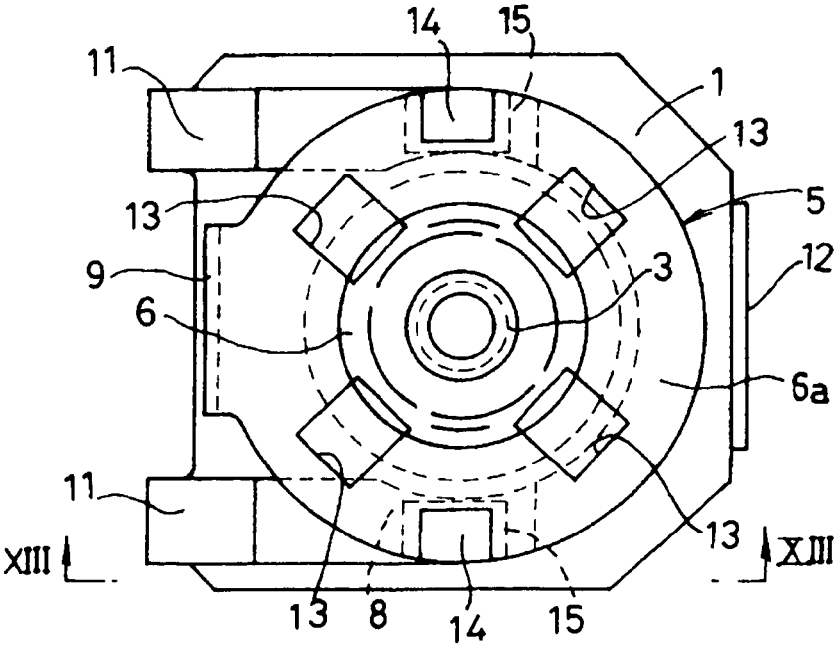
FIG. 12 is a plan view showing a variable resistor according to a fourth embodiment of the present invention.

(4) Fourth Embodiment (FIGS. 12–13)

FIGS. 12 and 13 illustrate a variable resistor according to a fourth embodiment of the present invention. In this embodiment, a lower plate 8 is used, and the driver engagement holes 13 are rotated about the shaft 3 through 45° clockwise or counterclockwise with respect to the hinge portion 9.

In this embodiment, as shown in FIG. 13, the protrusion 14 and the recess 15 are located at a middle point between the hinge portion 9 and the contact end 8*b*, differing from e.g. the second embodiment, in which the protrusion 14 and the recess 15 are closer to the hinge portion 9 than to the contact end 8*b* (see FIG. 8). This means that the distance (or span) between the hinge portion 9 and the protrusion 14 (or the recess 15) of the third embodiment is greater than that of the second embodiment. Accordingly, it is possible to reduce the moment exerted on the lower plate 8 in rotating the cup-shaped member 6 for resistance adjustment. Therefore, the deformation of the lower plate 8 can be prevented more reliably. This feature is also applicable to the case where the upper plate 7 is used.

In the illustrated example, each protrusion 14 does not extend entirely through the flange 6*a*, though the present invention is not limited to this. As in the second embodiment, each protrusion 14 may extend entirely through the flange 6*a*. Likewise, each recess 15 formed in the lower plate 8 may or may not extend entirely through the lower plate 8.

(5) Fifth Embodiment (FIGS. 14–16)

FIGS. 14–16 illustrate a variable resistor according to a fifth embodiment of the present invention.

In this embodiment, the driver engagement means is not a set of through-holes, but a set of downwardly bulging recesses 16. The lower plate 8 is formed with a pair of recesses 15 into which the corresponding two of the downwardly bulging recesses 16 (more appropriately called "downward protrusions" in this situation) are fitted. In this embodiment, two of the driver engagement recesses 16 also serve as protrusions to engage with the recesses 15 formed in the lower plate 8.

The present invention being thus described, it is obvious that the same may be varied in many ways. For instance, the configurations of the recesses and protrusions (such as the shape as viewed in plan or in cross section) are not limited to the illustrated examples. Further, the cup-shaped member may not be in an upwardly flaring form, but may have an upright side wall. The present invention is applicable not only to variable resistors but also to other kinds of variable electronic components provided with a rotor of a two-piece foldable type. Such variations are not to be regarded as a departure from the spirit and scope of the present invention, and all such modifications as would be obvious to those skilled in the art are intended to be included within the scope of the following claims.

The invention claimed is:

1. A variable electronic component, comprising an insulating substrate having an upper surface formed with a resistive layer, and a metal rotor rotatably attached to the upper surface of the substrate, wherein the rotor includes a cup-shaped member attached to the substrate and having an upper end formed with an outward flange, the rotor also including a plate member formed integral with the flange via a hinge portion, the rotor further including a contact member disposed at a position opposite to the hinge portion and held in sliding contact with the resistive lever, the cup-shaped member being open upward, the plate member being arranged on an upper side or a lower side of the flange, wherein one of the cup-shaped member and the plate member is formed with a recess, the other of the cup-shaped member and the plate member being formed with a protrusion fitted into the recess, the recess being depressed in a thicknesswise direction of the plate member and disposed between the hinge portion and the contact member, the protrusion projecting in the thicknesswise direction of the plate member and being disposed between the hinge portion and the contact member.

2. The variable electronic component according to claim 1, wherein the cup-shaped member and the plate member are formed integral with each other by sheet metal processing, the rotor being configured in a manner such that the flange and the plate member are vertically overlapped by folding at the hinge portion, thereby causing the recess and the protrusion to engage with each other.

3. The variable electronic component according to claim 2, wherein the plate member is arranged on the upper side of the flange.

4. The variable electronic component according to claim 2, wherein the plate member is arranged on the lower side of the flange.

5. The variable electronic component according to claim 1, wherein at least one of the cup-shaped member and the plate member is formed with an engagement part with which a screw driver engages.

6. The variable electronic component according to claim 1, wherein the plate member comprises a circular plate arranged on the upper side of the flange, the circular plate being formed with an engagement hole with which a screw driver engages, the cup-shaped member being provided, at a portion opposite to the hinge portion with respect to a rotating axis, with a contact member extending downward.

* * * * *